US008152533B1

(12) United States Patent
Lin

(10) Patent No.: US 8,152,533 B1
(45) Date of Patent: Apr. 10, 2012

(54) ELECTRICAL CONNECTOR

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/198,692

(22) Filed: Aug. 4, 2011

(51) Int. Cl.
*H01R 11/30* (2006.01)

(52) U.S. Cl. ..... 439/39; 439/712

(58) Field of Classification Search ..... 439/374, 439/38, 39, 701, 712
See application file for complete search history.

(56) References Cited

U.S. PATENT DOCUMENTS 7,445,452 B1 * 11/2008 Wu ..... 439/39
7,497,693 B1 * 3/2009 Wu ..... 439/39
7,963,773 B2 * 6/2011 Palli et al. ..... 439/38

* cited by examiner

*Primary Examiner* — Tulsidas C Patel
*Assistant Examiner* — Travis Chambers
(74) *Attorney, Agent, or Firm* — Cheng-Ju Chiang

(57) ABSTRACT

Provided is an electrical connector, including a case, a plurality of contacts and a magnetic unit. The case has a receiving cavity and formed by mounting a first shell, a second shell and a third shell. The second shell is mounted on the front of the first shell, and the third shell is mounted on the above of the first and second shells. The contacts are inserted into the case from the second shell, and pass through the receiving cavity to extend out of the first shell. Rear ends of the contacts are held by and soldered on the solder-assist pieces. The magnetic unit includes at least two magnetic bodies separately located on the upside and downside of the contacts, so that efficiently using the inside space of the electrical connector, increasing the size of the magnetic unit and enhancing the magnetic attraction.

7 Claims, 4 Drawing Sheets

ELECTRICAL CONNECTOR

BACKGROUND OF THE INVENTION

1. Field of the Invention

The present invention relates to an electrical connector, and more particularly to an electrical connector interconnected with a complementary connector by magnetic attraction.

2. Description of the Prior Art

An electrical connector is an important component used for transmitting communication signals in various electronic products. With the continuous development of electronic industry, various electrical connectors continuously appear. Generally, for realizing the connection between two interconnected electrical connectors, there are some latch structures in housing and outer shells of the two interconnected electrical connectors, so that realizing the interconnection object by the latch structures. But in the prior art, a magnetic electrical connector is interconnected with a complementary connector by a magnetic body mounted in the magnetic electrical connector. Please refer to FIG. 1, a magnetic electrical connector of the prior art includes a case, a plurality of contacts and a magnetic body 80. The case comprises a first shell 61, a second shell 62 and a third shell 63, which can be mounted together. The second shell 62 is mounted on the front of the first shell 61, and the third shell 63 fixedly covers the above of the first and second shells 61, 62 to define a receiving cavity (not shown). The first shell 61 disposes a plurality of contact-receiving grooves 611 on an outside surface of a bottom plate thereof. The second shell 62 disposes a plurality of contact-receiving holes 621 arranged in one row. The magnetic body 80 is placed into the receiving cavity. Each of the contacts 70 includes a retaining portion 71 being long plate-shaped, a contacting portion 72 being bent and extending upward from a front end of the retaining portion 71, and a soldering portion 73 horizontally extending backward from a rear end of the retaining portion 71. The contacting portion 72 disposes a connecting post 721 protruding forward. The retaining portion 71 is held in the contact-receiving groove 611. The contacting portion 72 extends into the receiving cavity and is placed on front of the magnetic body 80. The connecting post 721 passes through the contact-receiving hole 621 to extend out of the second shell 62. The soldering portion 73 extends out of the rear of the first shell 61 for being soldered on an outer circuit board (not shown).

However, the retaining portions 71 of the contacts 70 of the prior magnetic electrical connector are retained outside of the case, namely retained in the contact-receiving groove 611 located on the outside surface of the bottom plate of the first shell 61. But the contacting portions 72 of the contacts 70 extend into the receiving cavity, so that occupying and reducing the receiving cavity. Moreover, the magnetic body 80 must have a small size for being received in the reduced receiving cavity, so that resulting in a weak magnetic attraction.

BRIEF SUMMARY OF THE INVENTION

An object of the present invention is to provide a magnetic electrical connector having a strong magnetic attraction.

To achieve the above object, in accordance with the present invention, an electrical connector is provided, comprising a case, a plurality of contacts and a magnetic unit. The case has a receiving cavity and formed by mounting a first shell, a second shell and a third shell, the second shell is mounted on the front of the first shell, and the third shell is mounted on the above of the first shell and the second shell. The contacts are elongate post-shaped and are inserted backward into the case from the front of the second shell, wherein rear ends of the contacts pass through the receiving cavity to extend out of the rear of the first shell. The magnetic unit is accommodated in the receiving cavity and includes at least two magnetic bodies, which are separately located on the upside and downside of the contacts. The solder-assist pieces are fixed on an outside surface of the rear of the first shell, and the rear ends of the contacts are held by and soldered on the solder-assist pieces.

Based on the above description, the electrical connector of the present invention employs the magnetic unit, which is accommodated in the receiving cavity of the case and is located on the upside and downside of the contacts. The contacts are elongate post-shaped and located in the slots defined between the two magnetic bodies, thereby efficiently using the inside space of the electrical connector, increasing the size of the magnetic unit and enhancing the magnetic attraction.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
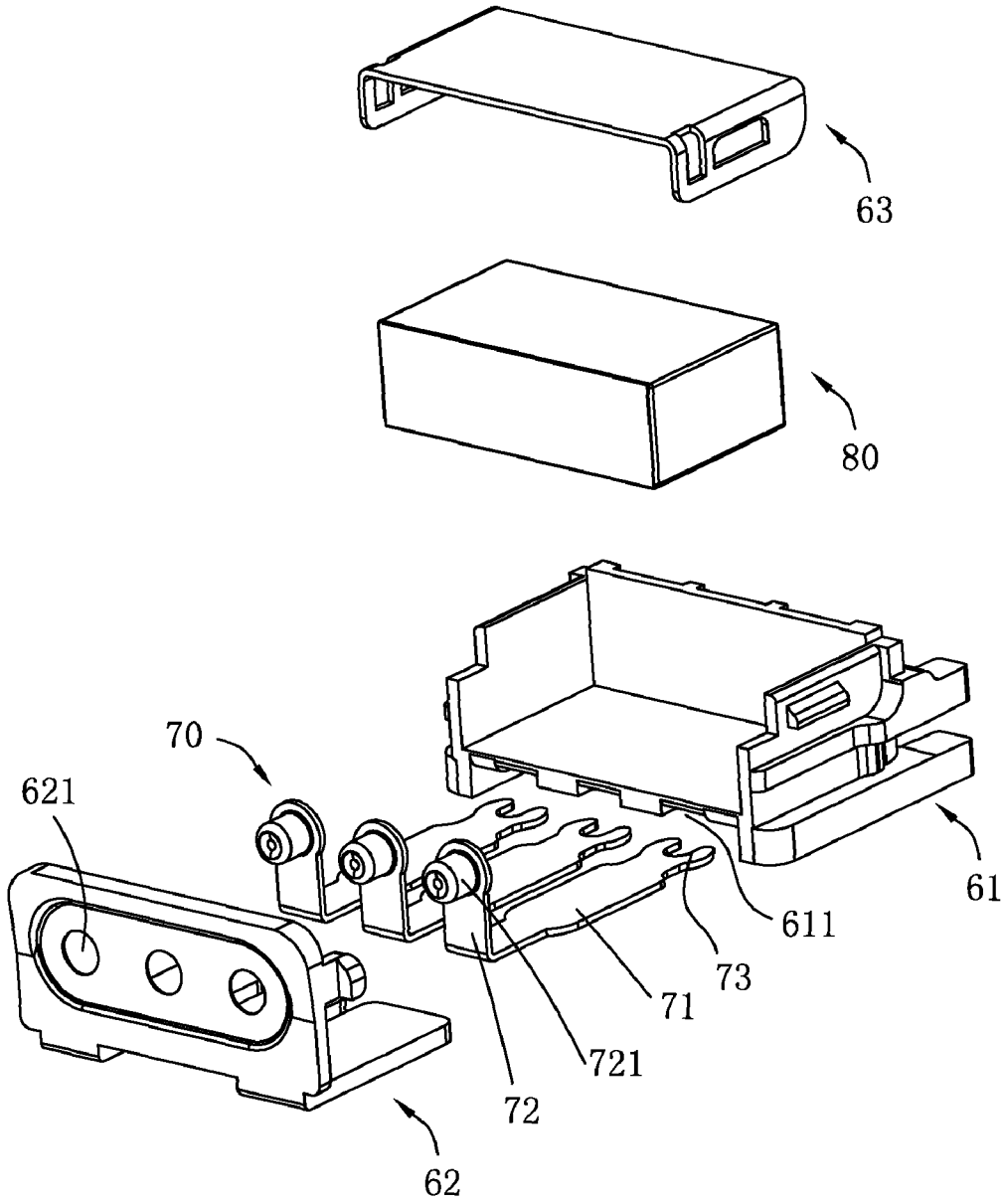
FIG. 1 (Prior Art)
FIG. 1 is an exploded perspective view of a prior electrical connector.
Figure 2:
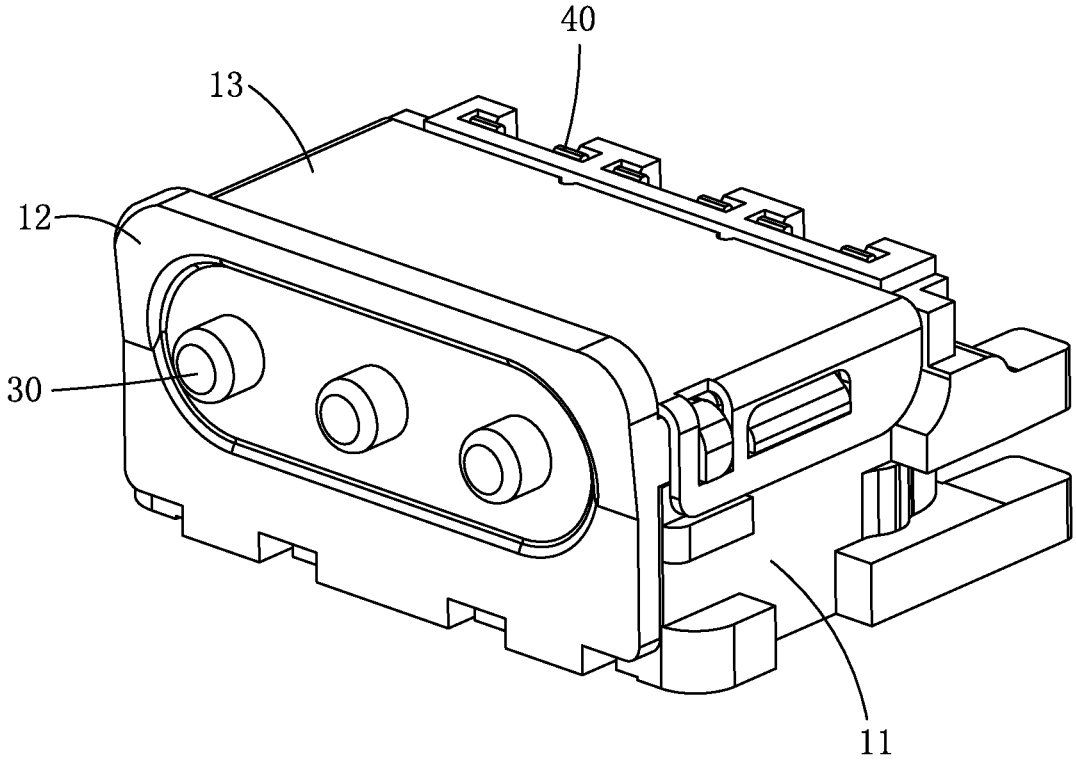
FIG. 2 is a perspective view of an electrical connector according to one preferred embodiment of the present invention.
Figure 3:
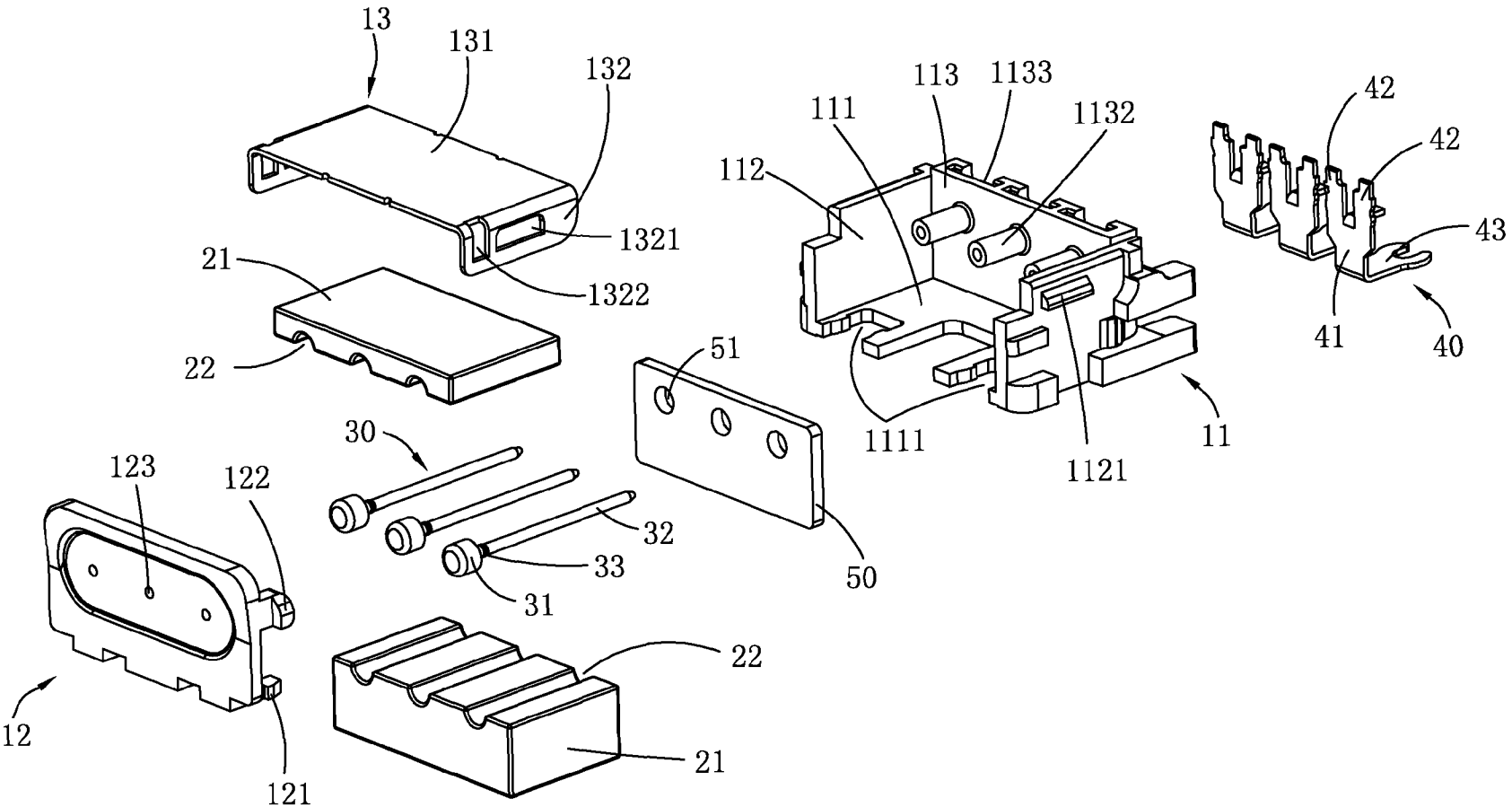
FIG. 3 is an exploded perspective view of the electrical connector of FIG. 2.

Referring to FIGS. 2 and 3, an electrical connector of the present invention comprises a case, a magnetic unit, a plurality of contacts 30, a plurality of solder-assist pieces 40 and a backing plate 50. The inside of the case forms a receiving cavity to accommodate the magnetic unit, the contacts 30 and the backing plate 50.

Figure 4:
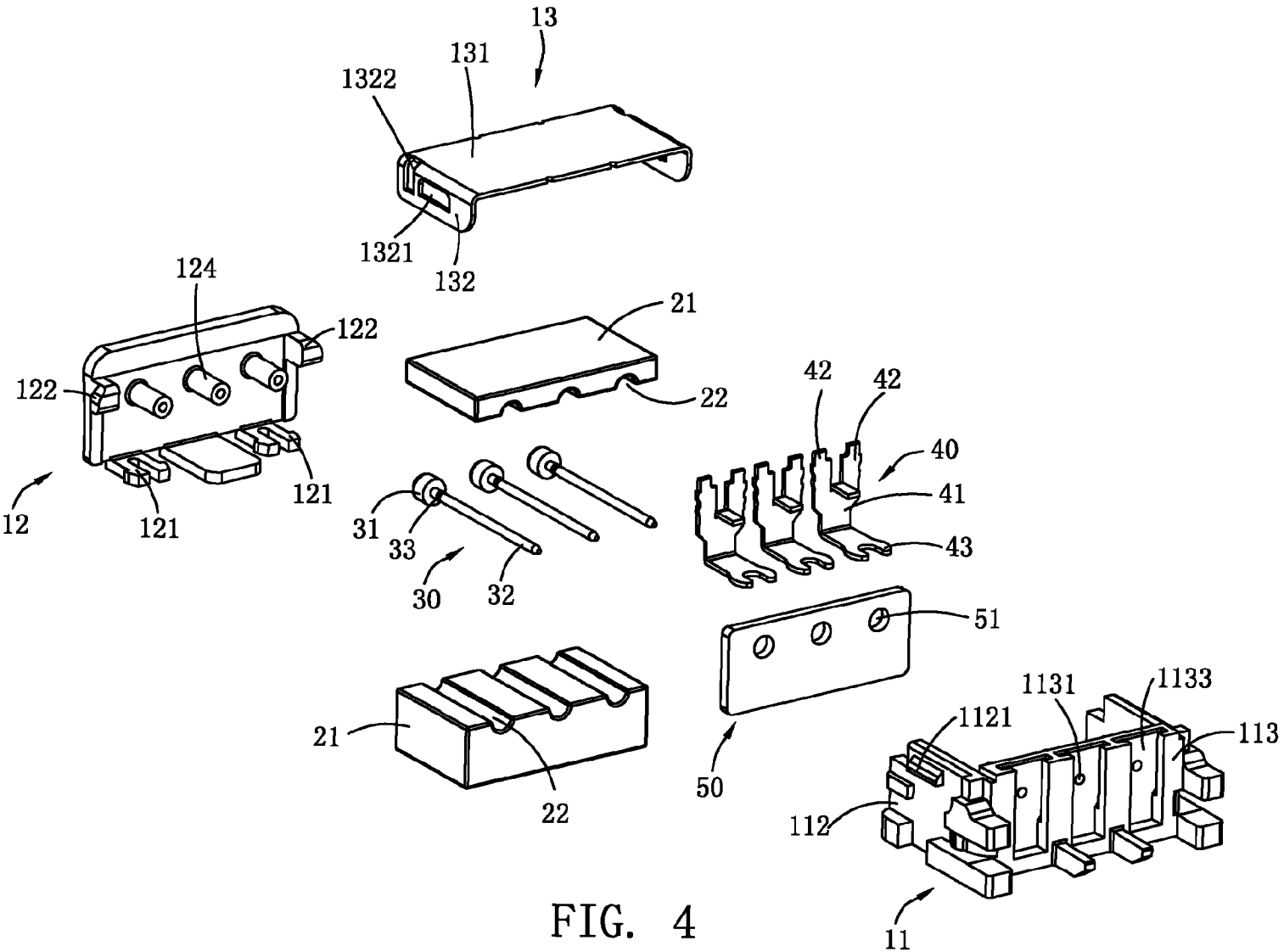
FIG. 4 is an exploded perspective view of the electrical connector of FIG. 2, along another angle of sight.

Please refer to FIGS. 2 to 4, in this embodiment, the case is formed by mounting a first shell 11, a second shell 12 and a third shell 13. The first shell 11 has a bottom plate 111, two side plates 112 and a rear plate 113. The bottom plate 111 disposes two retaining notches 1111 extending backward from a front edge thereof. Each of the two side plates 112 disposes a block 1121 protruding outward on an outside surface thereof. The rear plate 113 forms a plurality of retaining holes 1131 arranged in one row. The rear plate 113 disposes a plurality of insulating barrels 1132 formed on an inside surface thereof and separately extending from the peripheral edges of the retaining holes 1131. The rear plate 113 further disposes a plurality of holding grooves 1133 extending up and down on an outside surface thereof. The second shell 12 is mounted on the front of the first shell 11. The second shell 12 disposes two latches 121 extending backward from a lower edge thereof, and two locking lugs 122 separately located two side edges thereof and extending outward. The second shell 12 forms a plurality of holding holes 123 arranged in one row, and also disposes a plurality of insulating barrels 124 formed on an inside surface thereof and separately extending from the peripheral edges of the holding holes 123. The third shell 13 covers the above of the first shell 11, and has a cover plate 131 and two upright plates 132 separately being bent and extending downward from two side edges of the cover plate 131. Each of the two upright plates 132 disposes a retaining groove 1321 and a locking groove 1322, which are separately corresponding to the block 1121 and the locking lug 122. Specifically, the second shell 12 is fixed on the front of the first shell 11 by the engagement of the latches 121 with the retaining notches 1111, and the third shell 13 is fixed to the above of the first and second shells 12, 13 by the engagement of the retaining groove 1321 with the block 1121 and the engagement of the locking groove 1322 with the locking lug 122, thereby being mounted together to form the case.

Each of the contacts 30 is inserted into the case from the front of the second shell 12. The rear end of the contact 30 passes through the receiving cavity and the first shell 11 and extends out of the holding groove 1133. In this embodiment, the contact 30 is elongate post-shaped and includes a contacting portion 31 having a greater diameter, and a base 32 having a diameter smaller than that of the contacting portion 31 and connected to the contacting portion 31. The base 32 disposes a locking portion 33 being adjacent to the contacting portion 31 and protruding outward. The base 32 enters into the second shell 12 from the holding hole 123, orderly passes through the insulating barrels 124, 1132 to extend out of the rear of the case, and finally extends out of the holding groove 1133. Now, the contacting portion 31 is exposed outside of the second shell 12, the locking portion 33 is remained on the inside surface of the second shell 12 for retaining the front end of the contact 30.

The solder-assist pieces 40 are fixed on the outside surface of the rear of the first shell 11. Each of the solder-assist pieces 40 includes a connection segment 41 being upright plate-shaped, a clamp segment 42 extending upward from an upper end of the connection segment 41, and a soldering segment 43 being perpendicularly bent and extending backward from a lower end of the connection segment 41.

The magnetic unit comprises at least two magnetic bodies 21, which are separately located on the upside and downside of the contacts 30. Specifically, each of two opposite surfaces of the two magnetic bodies 21 disposes a slot 22 being half column-shaped and extending from front to rear. When the two magnetic bodies 21 are connected together, the two half column-shaped slots 22 are closed to form a column-shaped through hole (not shown).

The backing plate 50 disposes a plurality of apertures 51.

When assembling the electrical connector of the present invention, first, the backing plate 50 is placed on the rear of the first shell 11 and the apertures 51 enclose the insulating barrels 1132 of the first shell 11. Next, the two magnetic bodies 21 are placed onto the receiving cavity defined by the bottom plate 111, the two side plates 112 and the rear plate 113 of the first shell 11, and the slots of the magnetic unit enclose the insulating barrels 1132 of the first shell 11. Then, the second and third shells 12, 13 orderly cover the front and the above of the first shell 11, so that the magnetic unit is enclosed in the receiving cavity. And then the solder-assist pieces 40 are inserted downward into the holding grooves 1133 from the above of the first shell 11. Finally, the contacts 30 are inserted backward into the case from the front of the second shell 12, and the bases 32 of the contacts 30 pass through the slots of the magnetic unit and the retaining holes 1131 to extend out of the first shell 11 and the holding grooves 1133, so that the rear ends of the bases 32 of the contacts 30 are clamped by the clamp segments 42 of the solder-assist pieces 40, and are soldered on the clamp segments 42 by adopting the soldering method to complete the assembly of the electrical connector.

As described above, the electrical connector of the present invention employs the magnetic unit, which is accommodated in the receiving cavity of the case and is located on the upside and downside of the contacts 30. The contacts 30 are elongate post-shaped and located in the slots defined between the two magnetic bodies 21, thereby efficiently using the inside space of the electrical connector, increasing the size of the magnetic unit and enhancing the magnetic attraction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a case having a receiving cavity and formed by mounting a first shell, a second shell and a third shell, the second shell being mounted on a front of the first shell, and the third shell being mounted on the above of the first shell and the second shell;

a plurality of contacts being elongate post-shaped and being inserted backward into the case from the front of the second shell, wherein rear ends of the contacts pass through the receiving cavity to extend out of a rear of the first shell;

a magnetic unit being accommodated in the receiving cavity and including at least two magnetic bodies, which are separately located on an upside and downside of the contacts, the two magnetic bodies having two opposite surfaces, each of which forms a half column-shaped slot extending from front to rear; the two half column-shaped slots on the two opposite surfaces being closed to form a column-shaped through hole after the two magnetic bodies being connected together; and the contacts passing through the through hole of the magnetic unit to extend out of the rear of the first shell; and a plurality of solder-assist pieces being fixed on an outside surface of the rear of the first shell, and the rear ends of the contacts being held by and soldered on the solder-assist pieces.

2. The electrical connector as claimed in claim 1, wherein the first shell further has a bottom plate and two side plates, the bottom plate disposes two retaining notches extending backward from a front edge thereof, each of the two side plates disposes a block protruding outward on an outside surface thereof; the second shell disposes two latches extending backward from a lower edge thereof and two locking lugs separately located two side edges thereof and extending outward; the third shell has a cover plate and two upright plates separately being bent and extending downward from two side edges of the cover plate, each of the two upright plates disposes a retaining groove and a locking groove, which are being separately corresponding to the block and the locking lug; the second shell is fixed on the front of the first shell by the engagement of the latches with the retaining notches, and the third shell is fixed to the above of the first and second shells by the engagement of the retaining groove with the block and the engagement of the locking groove with the locking lug.

3. The electrical connector as claimed in claim 1, wherein each of the contacts includes a contacting portion having a greater diameter and a base having a diameter smaller than that of the contacting portion and connected to the contacting portion, the base disposes a locking portion being adjacent to the contacting portion and protruding outward; the first shell has a rear plate, and the rear plate forms a plurality of retaining holes arranged in one row and disposes a plurality of insulating barrels formed on an inside surface thereof and separately extending from the peripheral edges of the retaining holes, the rear plate further disposes a plurality of holding grooves extending up and down on an outside surface of the rear plate; the second shell forms a plurality of holding holes arranged in one row and also disposes a plurality of insulating barrels formed on an inside surface thereof and separately extending from the peripheral edges of the holding holes; the base of each of the contacts enters into the second shell from the holding hole, orderly passes through the insulating barrels of the second and first shells to extend out of the rear of the case, and finally extends out of the holding groove, the contacting portion of each of the contacts is exposed outside of the second shell, and the locking portion of each of the contacts is remained on the inside surface of the second shell for retaining a front end of the contact.

4. The electrical connector as claimed in claim 3, wherein each of the solder-assist pieces includes a connection segment being upright plate-shaped, a clamp segment extending upward from an upper end of the connection segment, and a soldering segment being perpendicularly bent and extending backward from a lower end of the connection segment; the solder-assist pieces are inserted into the holding grooves, and the rear end of the base of each of the contacts is clamped by the clamp segment of the solder-assist piece and is soldered on the clamp segments.

5. The electrical connector as claimed in claim 3, further comprising a backing plate, which disposes a plurality of apertures and is placed in the receiving cavity and on the rear of the first shell, wherein the apertures enclose the insulating barrels of the first shell.

6. An electrical connector comprising:

a case having a receiving cavity and formed by mounting a first shell, a second shell and a third shell, the second shell being mounted on a front of the first shell, and the third shell being mounted on the above of the first shell and the second shell;

a plurality of contacts being elongate post-shaped and being inserted backward into the case from the front of the second shell, wherein rear ends of the contacts pass through the receiving cavity to extend out of a rear of the first shell;

a magnetic unit being accommodated in the receiving cavity and including at least two magnetic bodies, which are separately located on an upside and downside of the contacts; and a plurality of solder-assist pieces being fixed on an outside surface of the rear of the first shell, and the rear ends of the contacts being held by and soldered on the solder-assist pieces;

wherein each of the contacts includes a contacting portion having a greater diameter and a base having a diameter smaller than that of the contacting portion and connected to the contacting portion, the base disposes a locking portion being adjacent to the contacting portion and protruding outward; the first shell has a rear plate, and the rear plate forms a plurality of retaining holes arranged in one row and disposes a plurality of insulating barrels formed on an inside surface thereof and separately extending from the peripheral edges of the retaining holes, the rear plate further disposes a plurality of holding grooves extending up and down on an outside surface of the rear plate; the second shell forms a plurality of holding holes arranged in one row and also disposes a plurality of insulating barrels formed on an inside surface thereof and separately extending from the peripheral edges of the holding holes; the base of each of the contacts enters into the second shell from the holding hole, orderly passes through the insulating barrels of the second and first shells to extend out of the rear of the case, and finally extends out of the holding groove, the contacting portion of each of the contacts is exposed outside of the second shell, and the locking portion of each of the contacts is remained on the inside surface of the second shell for retaining a front end of the contact.

7. An electrical connector comprising:

a case having a receiving cavity and formed by mounting a first shell, a second shell and a third shell, the second shell being mounted on a front of the first shell, and the third shell being mounted on the above of the first shell and the second shell;

a plurality of contacts being elongate post-shaped and being inserted backward into the case from the front of the second shell, wherein rear ends of the contacts pass through the receiving cavity to extend out of a rear of the first shell;

a magnetic unit being accommodated in the receiving cavity and including at least two magnetic bodies, which are separately located on an upside and downside of the contacts; and a plurality of solder-assist pieces being fixed on an outside surface of the rear of the first shell, and the rear ends of the contacts being held by and soldered on the solder-assist pieces;

wherein the first shell further has a bottom plate and two side plates, the bottom plate disposes two retaining notches extending backward from a front edge thereof, each of the two side plates disposes a block protruding outward on an outside surface thereof; the second shell disposes two latches extending backward from a lower edge thereof and two locking lugs separately located two side edges thereof and extending outward; the third shell has a cover plate and two upright plates separately being bent and extending downward from two side edges of the cover plate, each of the two upright plates disposes a retaining groove and a locking groove, which are being separately corresponding to the block and the locking lug; the second shell is fixed on the front of the first shell by an engagement of latches with retaining notches, and the third shell is fixed above the first and second shells by an engagement of the retaining groove with the block and an engagement of the locking groove with the locking lug.

* * * * *